US008753169B2

(12) United States Patent
Redenius

(10) Patent No.: US 8,753,169 B2
(45) **Date of Patent: *Jun. 17, 2014**

(54) ADJUSTABLE BREAST POSITIONING SYSTEMS FOR WOMEN'S GARMENTS AND RELATED METHODS

(76) Inventor: Ronald J. Redenius, Citrus Heights, CA (US)

( * ) Notice: Subject to any disclaimer, the term of this patent is extended or adjusted under 35 U.S.C. 154(b) by 531 days.

This patent is subject to a terminal disclaimer.

(21) Appl. No.: 13/014,715

(22) Filed: Jan. 27, 2011

(65) Prior Publication Data

US 2011/0117819 A1 May 19, 2011

Related U.S. Application Data

(63) Continuation-in-part of application No. 12/711,469, filed on Feb. 24, 2010, now Pat. No. 8,187,054, which is a continuation-in-part of application No. 12/290,163, filed on Oct. 27, 2008, now Pat. No. 7,677,951, which is a continuation-in-part of application No. 11/809,463, filed on May 31, 2007, now Pat. No. 7,497,760, which is a continuation-in-part of application No. 11/059,194, filed on Feb. 16, 2005, now Pat. No. 7,452,260.

(60) Provisional application No. 60/579,566, filed on Jun. 14, 2004.

(51) Int. Cl.
*A41C 3/00* (2006.01)

(52) U.S. Cl.
USPC ..... 450/59; 450/60

(58) Field of Classification Search
USPC ..... 450/30–33, 59–63, 65–68, 78; 2/90, 67, 2/73, 78.1–78.4, 113–115, 104–106
See application file for complete search history.

(56) References Cited

U.S. PATENT DOCUMENTS

| | | | | |
|---|---|---|---|---|
| 599,180 | A | 2/1898 | Harrison | |
| 1,400,056 | A | 12/1921 | Hadley | |
| 1,590,693 | A * | 6/1926 | McKeefrey | 450/61 |
| 2,100,890 | A | 11/1937 | Witkower | |
| 2,175,676 | A * | 10/1939 | Walters | 450/63 |
| 2,421,448 | A * | 6/1947 | Witkower | 450/63 |
| 2,621,328 | A * | 12/1952 | Duchnofskey | 450/53 |
| 2,678,446 | A | 5/1954 | Fellner | |
| 2,734,193 | A * | 2/1956 | Panes | 450/63 |
| 2,908,276 | A | 10/1959 | May | |
| 2,970,597 | A | 2/1961 | Michel | |
| 3,065,471 | A | 11/1962 | Lev | |
| 3,459,190 | A | 8/1969 | Frischer et al. | |
| 4,325,378 | A | 4/1982 | Wilkinson | |
| 4,530,361 | A | 7/1985 | Wooten | |
| 5,590,443 | A * | 1/1997 | Fildan | 24/200 |
| 5,868,601 | A | 2/1999 | Kelemencky | |
| 6,165,047 | A | 12/2000 | Scott et al. | |
| 6,213,842 | B1 | 4/2001 | Degirmenci | |
| 6,319,091 | B1 | 11/2001 | Kilbride et al. | |
| 6,390,884 | B1 | 5/2002 | Dragojevic | |
| 7,056,186 | B1 | 6/2006 | Wayenberg et al. | |
| 7,452,260 | B2 * | 11/2008 | Redenius | 450/63 |
| 7,497,760 | B2 * | 3/2009 | Redenius | 450/60 |

(Continued)

*Primary Examiner* — Gloria Hale
(74) *Attorney, Agent, or Firm* — John K. Buche; Buche & Associates, P.C.

(57) ABSTRACT

An improvement for an adjustable breast positioning system for a breast received within a breast cup of a woman's garment, and related methods.

44 Claims, 4 Drawing Sheets

(56) References Cited

U.S. PATENT DOCUMENTS

| | | | | |
|---|---|---|---|---|
| 7,517,273 | B2 | 4/2009 | Wooten | |
| 7,677,951 | B2 * | 3/2010 | Redenius | 450/60 |
| 8,187,054 | B2 * | 5/2012 | Redenius | 450/59 |
| 2007/0054597 | A1 | 3/2007 | Mone | |
| 2008/0125011 | A1 | 5/2008 | Gleeson | |
| 2010/0180358 | A1 | 7/2010 | Drummond et al. | |

* cited by examiner

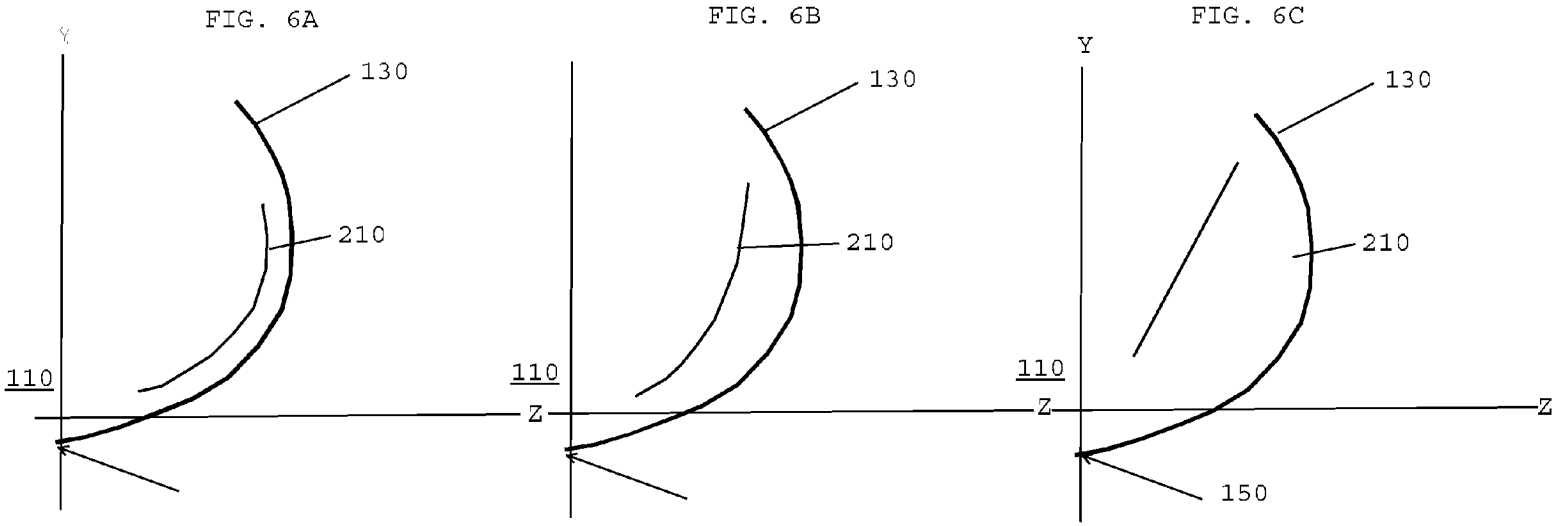
FIG. 6A
FIG. 6B
FIG. 6C
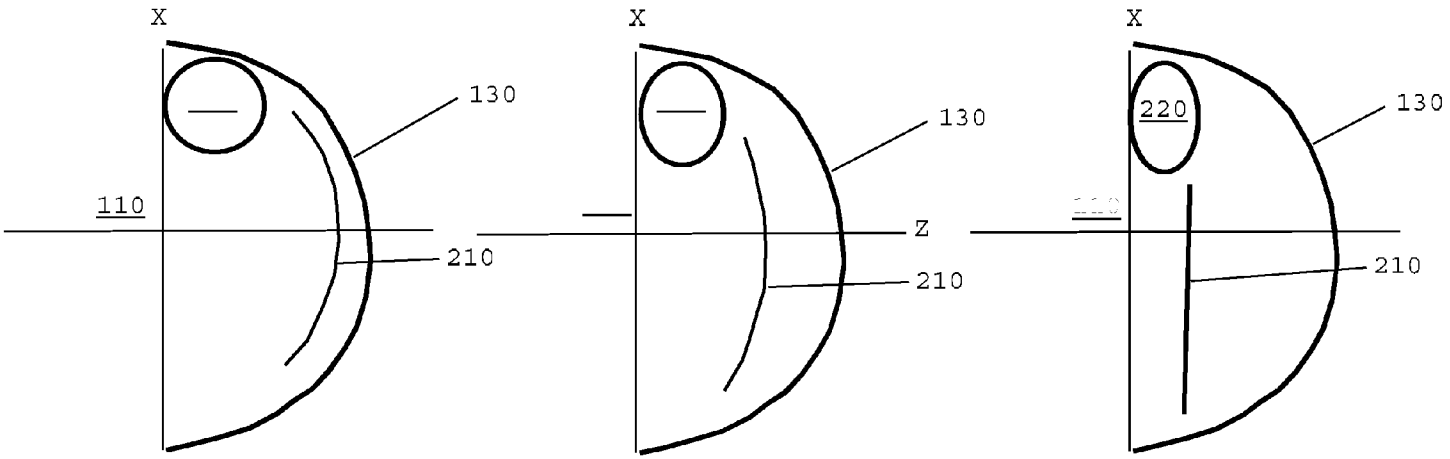
FIG. 7A
FIG. 7B
FIG. 7C

ADJUSTABLE BREAST POSITIONING SYSTEMS FOR WOMEN'S GARMENTS AND RELATED METHODS

CROSS-REFERENCE TO RELATED APPLICATIONS

This application is a continuation-in-part of U.S. patent application Ser. No. 12/711,469 (filed Feb. 24, 2010) which is a continuation-in-part of U.S. patent application Ser. No. 12/290,163 (filed Oct. 27, 2008) which is a continuation-in-part U.S. patent application Ser. No. 11/809,463 (filed May 31, 2007) which is a continuation-in-part U.S. patent application Ser. No. 11/059,194 (filed Feb. 16, 2005) which claims priority under 35 USC Section 119(e) to U.S. Prov. Pat. App. Ser. No. 60/579,566 (filed Jun. 14, 2004) all of which are incorporated herein by reference in their entireties.

STATEMENT REGARDING FEDERALLY SPONSORED RESEARCH OR DEVELOPMENT

None.

BACKGROUND OF THE INVENTION

1. Field of Invention

This invention relates generally to an adjustable breast positioning system for women's garments having breast cups and, in particular, to an adjustable breast positioning system for a brassiere, bra, or swimwear having breast cups wherein the adjustable breast positioning system independently reduces the available volume for each breast within each respective breast cup and displaces each breast upward, forward, and inward toward the center or cleavage area of the wearer's chest while concomitantly increasing the volume of each breast outside an upper portion of each respective breast cup for providing an improved visual presentation of the breast, a cosmetic enhancement of the breast, and/or a fashion trend.

2. Background.

Frequently, women desire the appearance of larger breasts and/or enhanced visual presentation of cleavage (i.e., the central area of a woman's chest and breasts that may not be covered by clothing). Accordingly, there is a need for a woman's garment, including bras and swimwear, which enlarges the appearance of the breasts while enhancing the visual presentation of cleavage.

Women's garments attempting to meet this need have been available for many years and have featured a variety of forms, however, these known garments have been inadequate in achieving cosmetic cleavage enhancement and/or fashion trend goals while still remaining comfortable. One reason for the stated inadequacy is that most conventional bras lift and shape the breasts as a mechanism for enlarging the appearance of breasts or cleavage enhancement, but such garments do so in a way that actually compresses the breasts against the woman's chest so that comfort is compromised. In addition to lost comfort, such compression resulting from conventional bras may actually reduce the size or profile of a wearer's breasts. Accordingly, there remains a need for woman's garments including bras and swimwear, which enlarge the appearance of the breasts while enhancing the visual presentation of cleavage.

Other known woman's garments for enlarging the appearance of breasts and/or enhancing the visual presentation of cleavage have been inadequate for failing to account for women with breasts that are not identical in size or shape (e.g., natural or injury induced size or shape variations between two breasts of the same woman). The stated failure to account for size and shape variations between breasts is an important limitation, among others, of known woman's garments because women with breasts of differing sizes or shapes may desire to adjust the shape, size, or appearance of one breast more than the other. One cause of this failure is the lack of independent cup adjustment in known women's garments. More specifically, conventional women's garments, and specifically bras, for enhancing the appearance of cleavage and/or breast size lack independent cup adjustment to an adequate degree because: (1) any vertically oriented adjustment is accomplished by adjusting the shoulder strap of the bra which has the effect of simultaneously raising and tightening, or simultaneously lowering and loosening the entire bra apparatus; and, (2) any horizontally oriented adjustment is accomplished by adjusting the horizontal distances between breast cups which has the effect of either (a) shifting the horizontal alignment of the breast cups, or (b) compressing the breasts with the cup, thereby changing the external looks an appearances (e.g., the physical dimensions and apparent structures that are observable while the apparatus is worn). See, e.g., U.S. Pat. No. 599,180 (issued Feb. 15, 1898), U.S. Pat. No. 1,400,056 (issued Dec. 13, 1921), U.S. Pat. No. 2,678,446 (issued May 18, 1954), U.S. Pat. No. 2,908,276 (issued Oct. 13, 1959), U.S. Pat. No. 2,970,597 (issued Feb. 7, 1961), U.S. Pat. No. 3,065,471 (issued Nov. 27, 1962), U.S. Pat. No. 3,459,190 (issued Aug. 5, 1969), U.S. Pat. No. 4,530,361 (issued Jul. 23, 1985), U.S. Pat. No. 5,868,601 (issued Feb. 9, 1999), U.S. Pat. No. 6,213,842 (issued Apr. 10, 2001) (FIG. 2 or 4) U.S. Pat. No. 6,319,091 (issued Nov. 20, 2001), U.S. Pat. No. 6,390,884 (issued May 21, 2002), U.S. Pat. No. 7,056,186 (issued Jun. 6, 2006) (including U.S. Pub. Pat. App. No. US 2006/0228988), and U.S. Pat. No. 7,517,273 (issued Apr. 14, 2009) disclosing bras with breast cups that adjust the appearance of cleavage via manipulation of the horizontal distance between the breast cups, wherein the external looks and appearances of the bra apparatus change after said manipulation; see also, e.g., U.S. Pat. No. 4,325,378 (issued Apr. 20, 1982), U.S. Pat. Nos. 4,530,361, 5,868,601, 7,056,186, and 7,517,273 disclosing bras wherein the breast cups are manipulated horizontally and wherein the horizontal manipulation of the breast cup results in compression of the breasts and breasts cups whereby the external looks and appearances of the bra apparatus are changed.

Moreover, bras typically fail to provide adjustability of the breast outside the perimeter of the cup or what is termed herein as the outside-of-cup appearance.

For the foregoing reasons, there is a need for a bra that overcomes the significant shortcomings of the known prior-art as delineated hereinabove.

SUMMARY OF THE INVENTION

In general, what is disclosed may be an adjustable breast positioning system for women's garments having breast cups. Suitably, the adjustable breast positioning system independently varies the volume capacity of each breast cup, and by doing so, affects the shape of a breast placed within the confines of each breast cup and the manner in which the breast is partially presented outside an upper periphery or perimeter of each breast cup for what is herein termed as the outside-of-cup appearance. It should be noted that manipulation of the disclosed breast positioning system may preferably vary the volume capacity of each breast cup without varying the external looks and appearances of the woman's garment.

The disclosed adjustable breast positioning system for women's garments having breast cups may allow for independent positioning of each of a wearer's breasts by positioning the wearer's breasts upward, orienting the breasts closer together or toward a center or cleavage area of a wearer's chest, and increasing the volume of the breast outside the upper portion or perimeter of each breast cup for providing an improved visual presentation of the breast, a cosmetic enhancement of the breast, and/or a fashion trend. Suitably, manipulating the disclosed breast positioning system does not substantially affect the external looks and appearances of the woman's garment.

A preferable embodiment of the disclosed adjustable breast positioning system for a breast cup of a woman's garment may comprise: a shaping member that is adjustably and connectedly situated within the confines of the breast cup; a stopper adjacent to, or partially overlaying, the shaping member, wherein both the stopper and shaping member are initially and approximately located against the inner contours of the breast cup so that the stopper is toward the side of the garment that is away from the center of a wearer's chest; and means for adjusting the shaping member (also referred to as "adjusting means") within the breast cup for creating a force on a breast positioned within the confines of the breast cup volume. Operably, (1) the force may preferably be applied to the breast over the surface area of the shaping member during manipulation of the adjusting means and (2) the stopper preferably directs the fluid movement of the breast in response to the pressure (i.e., the force over the area of the shaping member) forwardly, upwardly and toward a center or cleavage area of a wearer's chest (to increase the amount of breast outside the upper portion or perimeter of each breast cup). It should be noted that the side or confines of the breast cup may act as the stopper for directing the fluid movement of the breast in response to the pressure over the area of the shaping member.

A preferable adjusting means for the disclosed adjustable breast positioning system may comprise: a guide member having a portion secured to the shaping member for suspending the shaping member within the volume of the breast cup from its (i.e., the shaping member's) connection therein; an anchor element secured to a portion of the guide member away from its association with the shaping member, wherein the anchor element is attachable to a portion of the woman's garment outside of the breast cup.

A preferable shaping member of the disclosed breast adjusting system may, when in a first, initial, or "at rest" position, line a portion of the inside surface of the associated breast cup. In that position the shaping member generally conforms to the contours of the breast cup's confined volume. Preferably, manipulation of the adjusting means suspends the shaping member within the confined volume without affecting the outer looks or appearances of the breast cup. The suspension of the shaping member preferably (1) reduces the amount of volume within the breast cup available for any breast placed therein, and (2) creates a plane within the breast cup that causes the breast to move forward, upward, and towards the center of the woman's chest.

While embodiments discussed may reference bras, the breast positioning system of the present invention can be applied to any women's garment with breast cups, and any women's garment having breast cups could incorporate the system.

Accordingly, it should be apparent that numerous modifications and adaptations may be resorted to without departing from the scope and fair meaning of the claims as set forth herein below following the detailed description of the invention.

BRIEF DESCRIPTION OF THE FIGURES

The manner in which these objectives and other desirable characteristics can be obtained is better explained in the following description and attached figures in which:

FIGS. 6A, 6B, and 6C are a diagrammatical vertical cross sections of a breast cup 130; and, FIGS. 7A, 7B, and 7C are diagrammatical horizontal cross sections of the breast cup of 6A, 6B, and 6C respectively.

It is to be noted, however, that the appended figures illustrate only typical embodiments disclosed in this application, and therefore, are not to be considered limiting of its scope, for the invention may admit to other equally effective embodiments that will be appreciated by those reasonably skilled in the relevant arts. Also, figures are not necessarily made to scale.

DETAILED DESCRIPTION OF PREFERRED EMBODIMENTS

A preferable woman's garment according to the present disclosure generally comprises breast cups and an adjustable breast positioning system for independently displacing the breast forward, upward, together, and further outside the confines of the breast cups for accentuating the appearance of cleavage and increasing the apparent size of the breast for providing an improved visual presentation of the breast, a cosmetic enhancement of the breast, and/or a fashion trend. The more specific aspects of the preferable woman's garment are best disclosed with reference to the figures.

Figure 1:
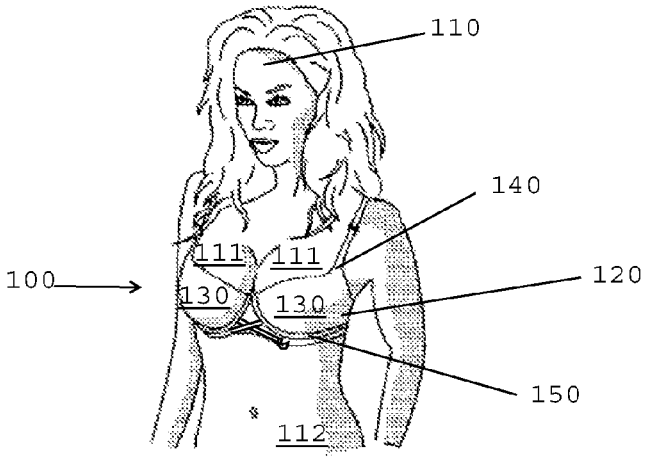
FIG. 1 shows an adjustable breast positioning garment 100 being worn.

FIG. 1 shows a preferable garment 100 with adjustable breast positioning system being worn by a woman 110. The figure illustrates the general features of the garment 100, which are: a chest band or encircling portion 120 that wraps around or passes around the torso of a wearer; breast cups 130 attached to the front of the chest band 120, or incorporated into the front of the chest band 120; optional shoulder straps 140, which attach to the breast cups 130, pass over the shoulders, and attach to the chest band or encircling portion 120 at the back of the wearer, and; for some garments 100, a stiffening device 150 such as an under-wire or plastic member that is incorporated into the garment 100 at the junction of the chest band 120 and breast cups 130 and which partially encircle the breasts 111 on the bottom side. The recited aspects of the garment 100 generally function as depicted and in their known manner, for example: the chest band or encircling portion 120 generally functions to hold the garment 100 around the body of the woman 110; the breast cups 130 generally and respectively retain at least a portion of the woman's 110 breasts 111 within their volume, or concavity;

the shoulders straps 140 function to prevent the garment 120 from slipping down the woman's 110 torso 112 under the weight of the breasts 111 or by gravity, although in an alternate embodiment, the garment 110 may be shoulder strapless (i.e., relying on the constriction of the encircling portion 120, or some other means (e.g., adhesive or the like), to prevent the garment 110 from slipping down the woman's torso 112). Other aspects of the garment 110 may also be known or readily ascertainable by those of skill in the art, e.g., the breast cups 130 may be made of more than one layer with some of those layers possibly made of a thicker padding material, or thicker padding material may be inserted between layers. Also, some layers, such as a padding layer, may extend over only a portion of breast cup 130 as it is not necessary that all layers cover the same area. In addition to the known aspects recited above, the garment 110 preferably features an adjustable breast positioning system that is not entirely visible in FIG. 1, and is therefore better disclosed in connection with the other figures which show the garment 110 in more detail.

Figure 2A:
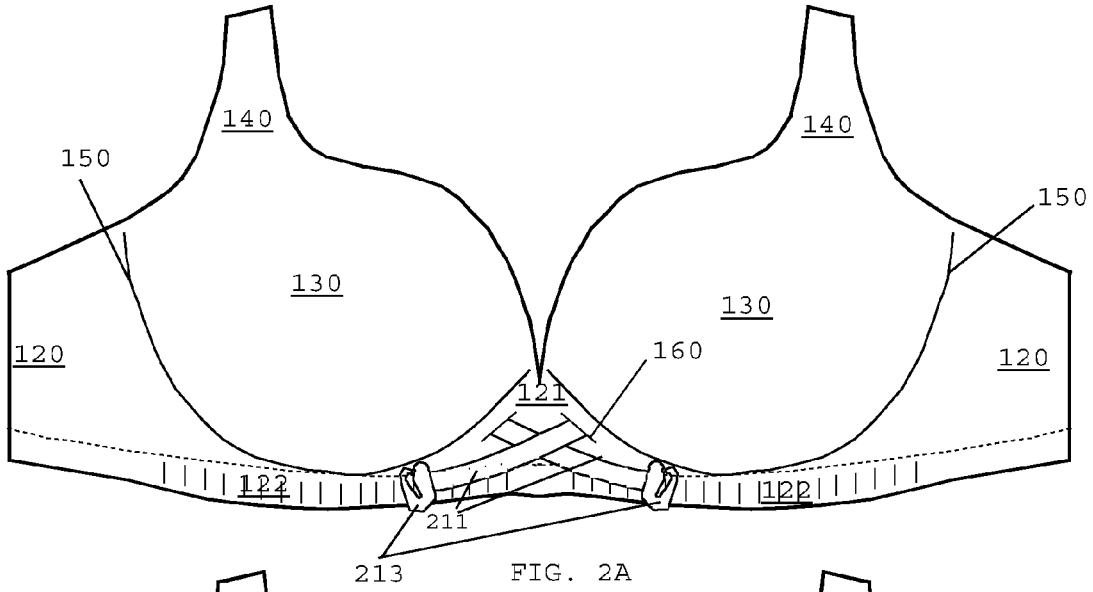
FIG. 2A is a front view of the garment 100 of FIG. 1 in a configuration.
Figure 2B:
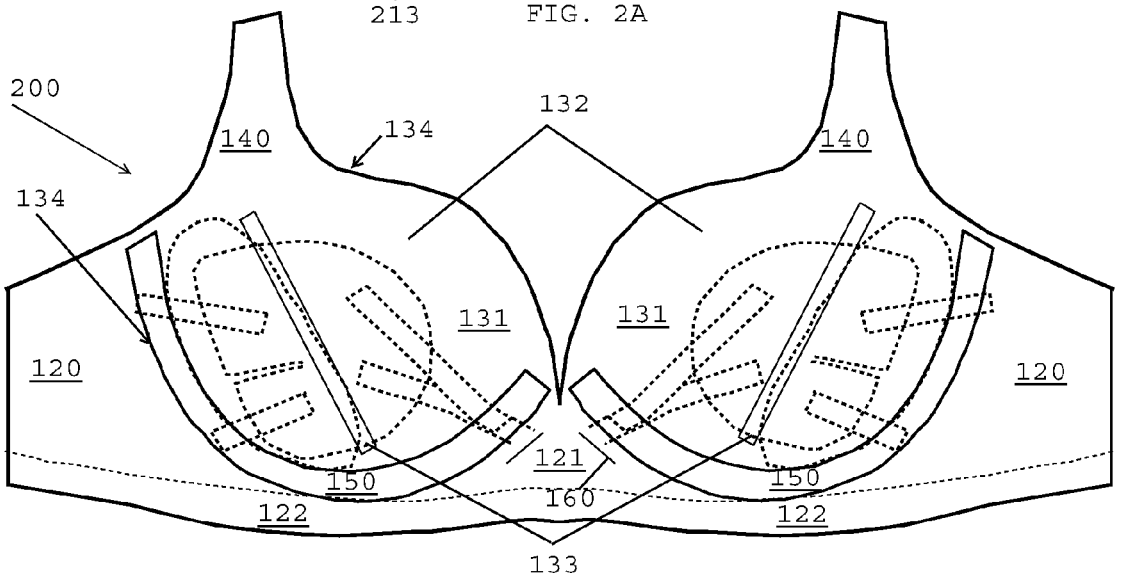
FIG. 2B is a back view of the garment 100 the configuration of FIG. 2A.
Figure 2C:
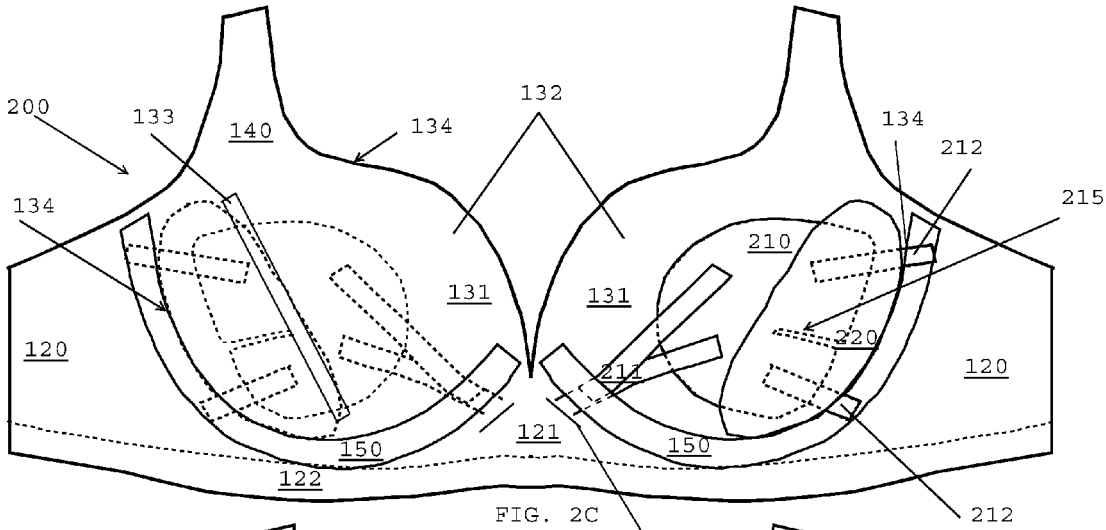
FIG. 2C is a disassembled back view of the garment 100 depicted in 2B.

FIGS. 2A through 2C illustrate preferable structures and components of the garment 100 depicted in FIG. 1. More specifically: FIG. 2A shows a front portion of the garment 100; FIG. 2B shows a back, or inside, portion of the garment 100; and, FIG. 2C shows the back view of the garment 100 depicted in FIG. 2B with the garment 100 being partially disassembled. As depicted in FIGS. 2A through 2C, the garment 100 preferably features: breast cups 130 positioned at the front of the garment 100, the breast cups 130 projecting forward from their rims or perimeters 134 and each one defining a contained volume 131 or concavity; the chest band or chest encircling portion 120 extending from the sides of the breast cups 300; shoulder straps 400, which attach to the breast cups 300 to pass over the shoulders of a wearer to a connection with the chest band or chest encircling portion 120 at the back of the wearer; a central panel 121 that connects the breast cups 130 at the front of the wearer and that generally defines the front of the chest band or encircling portion 120; a fastening portion 122 underneath the breast cups 130 and along the chest band or chest encircling portion 120; for some garments 100, a stiffening device such as an under-wire or plastic member 150 that is incorporated into the garment 100 at the lower periphery of the breast cups 130 and which partially encircle the breasts on the bottom side; and, an adjustable breast positioning systems 200, suitably disposed within each contained volume 131 of the breast cups 130, beneath a cover layer 132 featuring a breast grip 133.

The structures or components of the preferable breast positioning system 200 are best depicted (1) in FIG. 2C, which shows the back portion of the garment 100 that is partially disassembled with the cover layer 132 and breast grip 133 removed from the back or inside of the right breast cup 130, and (2) with brief reference to the front central portion 121 depicted in FIG. 2A. Referring primarily to FIG. 2C, the breast positioning system 200 ideally features: a pliable shaping member or press 210 with a cutout 215; at least one guide member 211 that connects on one end to the shaping member 210 while extending through the central portion 121 to the front of the garment 100 to a connection with an attachment means 213 at the other end (see FIG. 2A); two connecting members 212 that affix to the shaping member 210 (preferably one on each side of the cutout 215) and the rim 134 of the bra cup 130; and, a stop or blocker 220, suitably overlaying at least a portion of the shaping member 210. When positioned in the configuration shown in FIGS. 2A through 2C, the guide member 211 and connecting members 212 are preferably and relatively slack, while the shaping member 210 suitably follows the contours of the breast cup 130 volume 131 (the cutout 215 is preferably closed in the depicted configuration so that the shaping member 210 follows the inner contours of the breast cup 130 without substantial bunching or folding of its material.). As discussed below in greater detail, the adjustable breast positioning system 200 can be locked in the configuration depicted in FIGS. 2A through 2C via interaction between the attachment means 213 of the guide member 211 and the attaching portion 122 of the encircling portion 120.

Figure 3A:
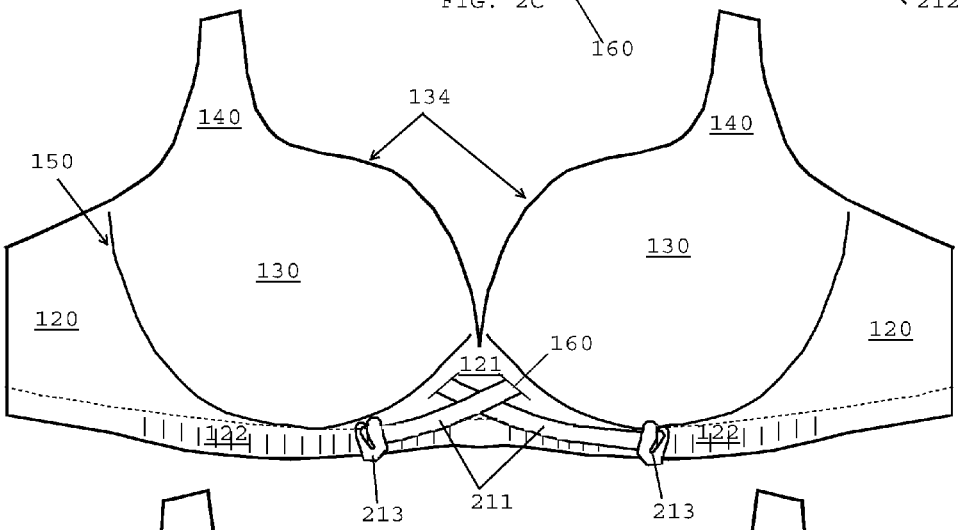
FIG. 3A is a front view of the garment 100 of FIG. 2A in another configuration.
Figure 3B:
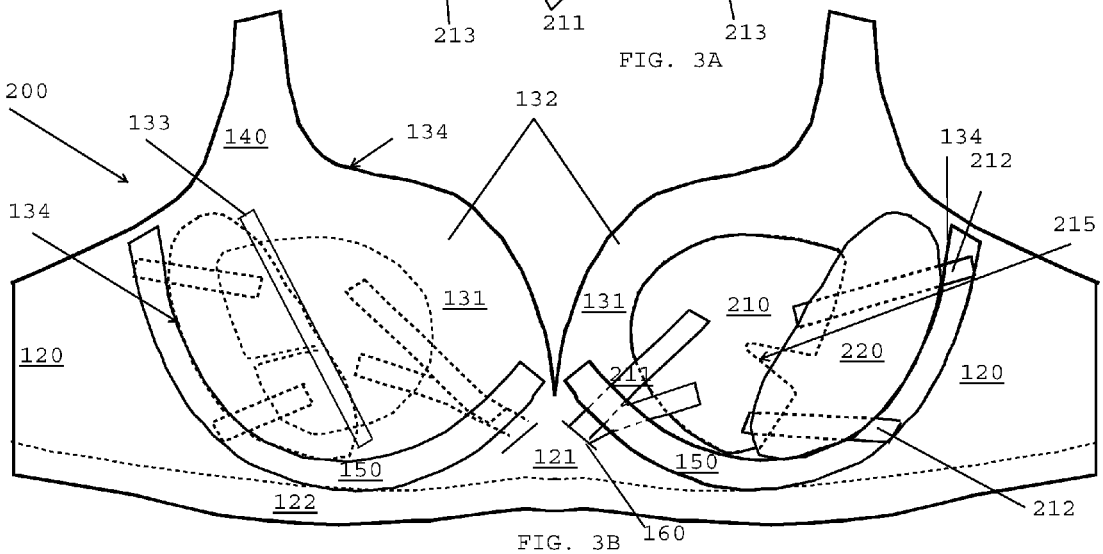
FIG. 3B is a disassembled back view of the garment 100 depicted in 3A.
Figure 4:
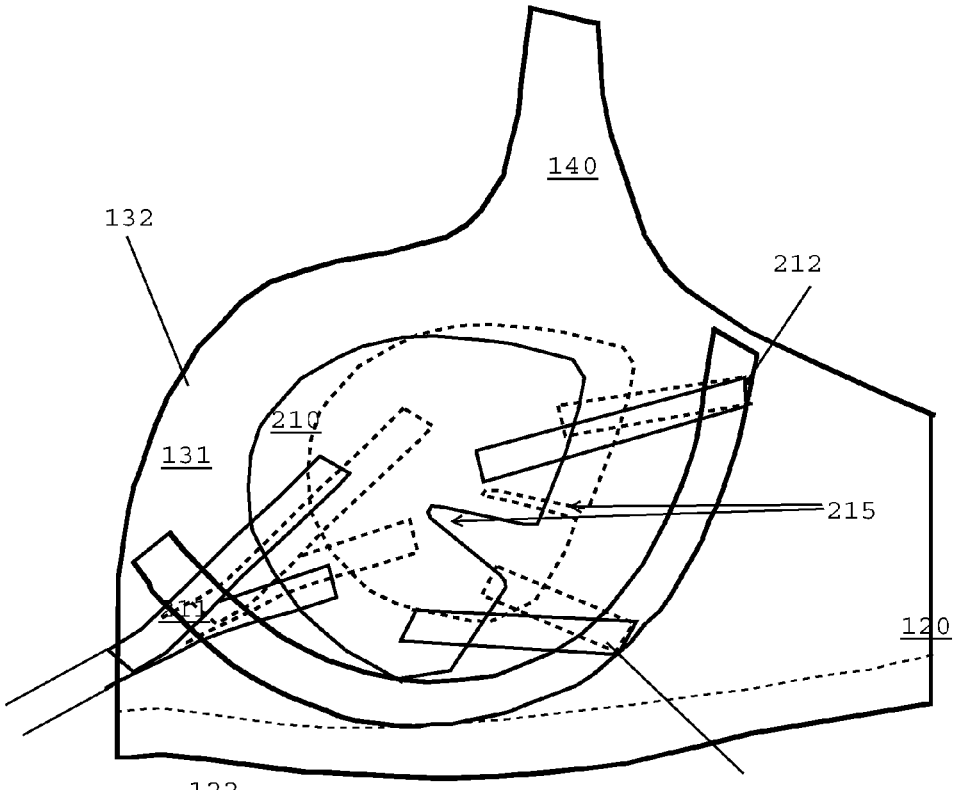
FIG. 4 is a disassembled back view of the right breast cup of the garment 100 depicted in FIGS. 1 through 3B.

FIGS. 3A and 3B depict the garment 100 in the same manner as FIGS. 2A and 2C respectively, but with the adjustable breast positioning system 200 of the right breast cup (with respect to a wearer) preferably shown in an alternate configuration. By comparison: the guide member 211 of the right breast cup 130 depicted in FIG. 3A is preferably drawn further toward the left breast cup 130 than the same guide member 211 depicted in FIG. 2A; the guide member 211 of the right breast cup 130 depicted in FIG. 3B is preferably drawn further toward the left breast cup 130 than the same guide member 211 depicted in FIG. 2C; the shaping member 210 of the right breast cup 130 depicted in FIG. 3B is preferably drawn further toward the left breast cup 130 than the same shaping member 210 depicted in FIG. 2C; the pliable shaping member 210 of 3B is preferably taut with the cutout 215 open to flatten and stiffen the shaping member as it is suspended within the contained volume 131 of the breast cup between the taut/stretched connecting members 212 and the guide member 211, whereas the same components depicted in FIG. 2C are preferably slack and suitably align the contours of the contained volume of the breast cup 130 (the three-dimensional aspects of the adjustment system are discussed in greater detail in connection with FIGS. 5 through 7C). As alluded to above but discussed further below, the adjustable breast positioning system 200 can be locked in the configuration depicted in FIGS. 3A and 3B via interaction between the attachment means 213 of the guide member 211 and the attaching portion 122 of the encircling portion 120. FIG. 4 highlights the recited aspects of the differing configurations by simultaneously showing the right breast cup 130 and the breast positioning system 200 of FIGS. 2C and 3B (the configuration of FIG. 2C being drawn in dashed lines). As discussed in further detail below, the adjustable breast positioning system 200, and correspondingly the garment 100, may operate to adjust the position of a wearer's breast by switching the configurations of the system 200 between the initial configuration depicted in FIGS. 2A through 2C and another configuration depicted in FIGS. 3A and 3B, and/or vice versa (and/or by interpolating or extrapolating any configuration from said configurations).

As mentioned above, the preferable adjustable breast positioning system 200 within each breast cup 130 of the garment 100 independently displaces a breast forward, upward, horizontally (generally toward the center of the wearer's chest), and further outside the confines of the breast cups for (1) accentuating the appearance of cleavage, (2) increasing the apparent size of the breast, and (3) providing an improved visual presentation of the breast. The recited displacement of the breast occurs whenever one of the adjustable positioning systems 200 is manipulated from the configuration of FIG. 2A through 2C to the configuration of FIGS. 3A and 3B. This manipulation is also shown in FIG. 4 as the transition from dashed to solid lines. Operably, a breast is displaced by changing the position of the pliable shaping member 210 as discussed above since a larger portion of the confined volume 131 of the breast cup 130 is available to be occupied in the initial configuration (dashed lines of FIG. 4) than in the later configuration (solid lines of FIG. 4) (the three-dimensional aspects of the adjustment system are discussed in greater detail in connection with FIGS. 5 through 7C). More specifically, in the initial configuration (dashed lines of FIG. 4), the pliable shaping member 210, guide member 211, and connecting members 212 may be relatively slack and, therefore, generally conforms to the inner contours of the breast cup's confined volume, whereas the same components in the later configuration (solid lines of FIG. 4) are relatively taut, elastically stretched and/or more rigid so that the pliable member spans the confined volume 131 of the breast cup 130 thereby reducing the volume available therein for a breast.

Operably, constriction of the garment 100 around the chest of a wearer via the chest band or encircling portion 120 plus the above recited tautening and/or suspension of the shaping member 210 produces a force over the surface of the shaping member 210 against the wearer's breast positioned within the breast cup 130, wherein the force over the area causes the breast, the breast being semi-fluid or malleable, to flow upwardly, horizontally (generally toward the center of the wearer's chest), and further outside the confines of the breast cup 130. The upward and forward movement of the breast is dictated by the angle of inclination or pitch (relative to the plane of the wearer's chest) of the taut or tautening shaping member against the breast. The horizontal movement of the breast toward the center of the wearer's chest is directed by the stopper 220, which restricts horizontal movements of the breast away from the center of the wearer's chest. It should be noted that a grip strip 133 may be provided to the stopper 220 (whether on the stopper itself or on the cover 132 over the stopper 220) so that it may better act to restrict the horizontal movement of the breast. A preferable material for the grip strip is silicon, but any other material that produces friction with human skin may be used and will be readily apparent to those of skill in the art. A preferable material for the stopper 220 is foam, memory foam, and/or the like. It should be noted that the stopper 220 need not be a separate member since the side or confines of the breast cup may act as the stopper for larger breasted women, and in such an embodiment, the yaw angle of the shaping member 210 may further direct the horizontal flow of the breast material.

In order to better disclose the three-dimensional affect of manipulating the adjustable breast positioning system 200, FIGS. 5 through 7C diagrammatically illustrate the component translation when the pliable shaping member 210 is adjusted from a first to a second position and illustrates a reference coordinate system wherein the positive Z axis is in the direction the wearer is facing, the positive Y axis is in a vertical or upward direction relative to the wearer, and the X axis is the horizontal axis with its positive direction being relative to each breast and being toward a center or cleavage area of the wearer's chest.

Referring to FIGS. 2C, 3B, and 5 through 7C, the breast positioning system 200 comprises the pliable shaping member 210 situated at a first position generally along the inner contours of the confined volume 131 of the breast cup 130. In order to conform generally to the contours of the inner volume 131, the pliable shaping member 210 may feature a cutout 215 which is generally pie or v-shaped and two connecting members 212 for affixing the platform 210 on both sides of the cutout 131 to the breast cup 130, wherein the cutout 215 allows a slack platform 210 (as in the initial position) to follow the contours of the inner breast cup 130 without bunching or folding to a significant degree. When conformed to the contours of the breast cup 130, the pliable shaping member 210 may feature a curvilinear shaped section having, when said pliable member 210 is situated at a first position, a first curvature transitioning from the attached end and extending along the contours of the breast cup 130 (see FIGS. 6A and 7A). The system 200, may preferably respond to a force (e.g., pulling by hand) along the guide member 211 of the pliable shaping member 210 toward the center section 121 of the garment 110 while the pliable shaping member is retained by the connecting members 212 for (1) decreasing the first curvature of the pliable shaping member 210 to a second different curvature less proximate to the lower periphery of the breast cup than the first curvature (see FIGS. 6B and 7B), (2) reducing the available breast cup volume within the breast cup for providing breast positioning by displacing the breast upward along the positive Y axis, forward along the positive Z axis, and inward toward the center of the wearer's chest along the horizontal positive X axis while concomitantly increasing the volume of the breast outside an upper portion of the breast cup for providing an improved visual presentation of the breast. In regard to forward and upward movement of the breast, a force along the guide member draws the pliable platform 210 away from the inner contours of the breast cup 130 and, correspondingly, tautens the connecting members 212 and shaping member 210 so that the pie shaped cutout 215 opens while the shaping member stiffens to generally become an inclined plane, which plane directs the force against the breast forwardly and upwardly (see FIG. 6C). In regard to the horizontal movement of the breast, the force of the shaping member 210 against the breast presses the breast in all horizontal directions, but the stopper 220 restricts the horizontal movement of the breast in the direction away from the center of the wearer's chest (in an alternate embodiment, with or without a stopper 220, the yaw of the taut shaping member may also direct the horizontal movement of breast material). It should be noted that the connecting member 212 may preferably be elastic so that the connecting members 212 (1) pivot around the connection of the connecting members 212 to the breast cup 130, and (2) stretch in response to force along the guide member 211 and shaping member 210 whereby the shaping member 210 can remain in contact with the same position of the breast and thereby continue to apply the adjusting force (i.e., the shaping member 210 moves with the breast rather than merely pivot around the connection of the connecting members 212 to the breast cup 130 and slide along the breast) (see, e.g., FIGS. 7A through 7C). In one embodiment, the force may be applied along the guide member 211 with continued application via pulling the guide member 212 and anchoring the attachment means 213 to the fastening portion 122 (see FIGS. 2A and 3A) of the garment 100. The attachment means 213 may preferably be movable from place to place on the fastening portion 122 of the garment 100 for adjusting a degree of decrease of the second different curvature from the first curvature of the pliable shaping member.

Figure 5:
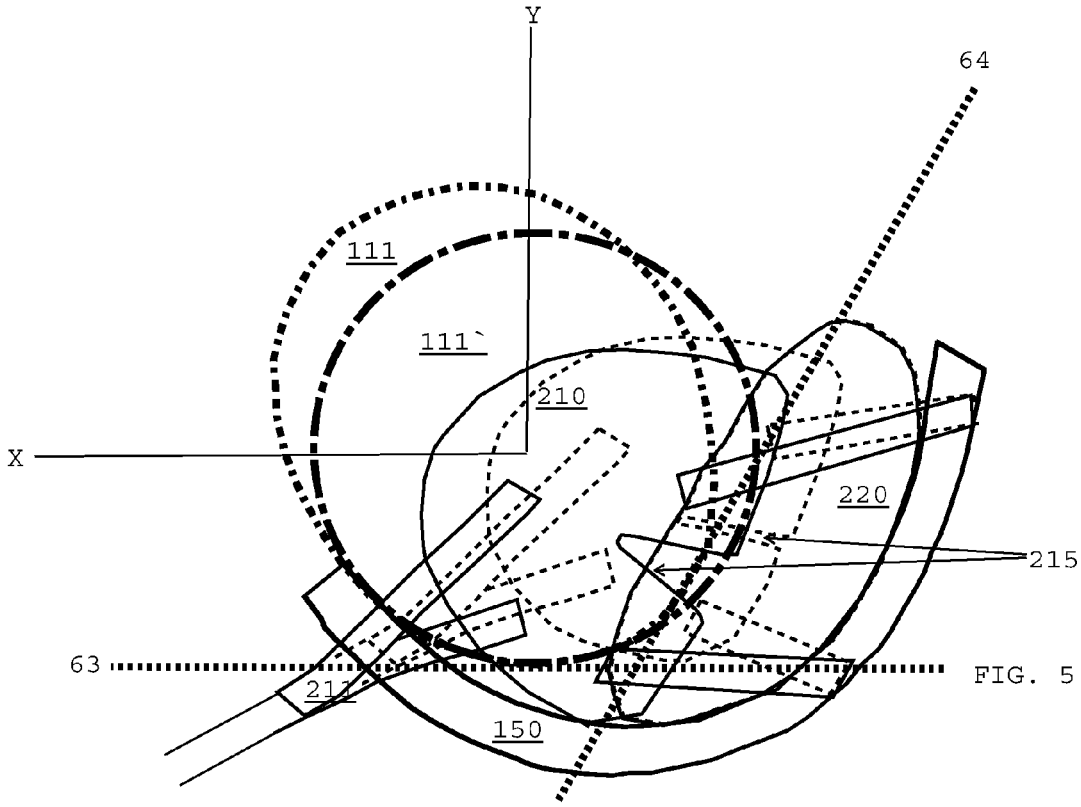
FIG. 5 is a diagrammatical view of the adjustable breast positioning system 200 of the garment 100 depicted in FIGS. 1 through 4.

FIG. 5 diagrammatically illustrates the breast translation when the pliable shaping member 210 is adjusted from the first to the second position wherein: (a) when the pliable shaping member 210 is in the first position (dashed lines) the breast is illustrated by the breast 111' and (b) when the pliable shaping member is adjusted to the second position (solid lines) the breast 111' is pushed upward in the positive Y direction, forward away from the chest of the wearer in the positive Z direction, and closer together or toward the center of the chest along the positive X direction resulting in a breast position as illustrated by the breast 111. Additionally, the pliable shaping member or press 210 provides breast constraint along line 63 when the pliable shaping member 210 is adjusted from the first to the second position and the stopper or block 220 provides breast constraint along the line 64 (in an alternate embodiment, with or without a stopper, the yaw of the shaping member 210 may also provide breast constraint along the line 64.

Referring once again to 2A through 3B, the path of pliable shaping member 210 may be guided by loops 160 which, in one embodiment, are slits, flattened loops, or other type of aperture through the center portion 121 of the garment 100 adjacent to the breast cup 130. Loops 160 keep the guide member 211 oriented in a particular direction relative to the breast cup 130. Guide loop 160 can be sized and/or located for controlling the degree of inclination of the shaping member 210 or force acting on the shaping member 210 when in an adjusted position.

Referring now to the profile views of FIGS. 6A through 6B, and in one embodiment, it is desirable for the pliable shaping member or press 210 to remain close to the body 110 of the wearer as it positions the breast, rather than move along the contour of breast. Pliable shaping member or press 210 may be seen in a first or "at rest" position relative to body 110 in FIG. 6A and in an adjusted, second, or active position relative to body 110 in FIG. 6B or 6C.

In one embodiment, and referring back to FIGS. 2A through and 3B, the path of the pliable shaping member 210 is guided by a guide member 211. The guide member 211 causes the pliable shaping member 210 to suspend within the breast cup 130 close to the body of a wearer as the pliable shaping member 210 is actuated by a force on the guide member 211. This ensures that the motion of pliable shaping member 210 provides positioning and does not merely slide along the breast of a wearer. In one embodiment, the guide member 210 works under a tensile load and therefore may be constructed from nylon strand or similar flexible material and will be a tensile member having at least two ends. A first end of the guide member 211 is attached to the pliable shaping member 210 within the breast cup, while a second end 150 is attached to an attachment means 213 that may be anchored to the garment 100 at the fastening portion 122 outside of the breast cup 130 (see FIGS. 2A and 3A). Although the attachment means 213 is depicted as an S-hook and the fastening portion 122 is depicted as a plurality of loops for interaction with the S-hook, any manner of cooperating attachment mechanisms may be employed as the attachment means 213 and fastening portion 122, like, for example a plurality of hook and loops (e.g., Velcro®), buttons, snaps, ties, or the like. Such, modifications will become readily apparent to those of skill in the art after reading this disclosure.

Turning now to the pliable shaping member 210, as shown in FIGS. 2B, 2C, 3B, and 4 through 7C, a cover layer 132 may cover the pliable shaping member 210 so that it cannot make direct contact with the wearer. As shown in FIG. 6A through 7C, the shaping member 210 preferably lays along and conforms to the lower contours of the inside of the breast cup in an initial position (see FIGS. 6A and 7A). Suitably, the shaping member 210 is held slackly in that location by the connecting members 212 while in the initial position. This leaves pliable shaping member 210 free to pivot, move, flex, and change position when acted on by a force along the guide member 211.

In one embodiment, the shaping member 210 is made of thin plastic sheeting of a thickness making it highly flexible, but retaining the ability to support and position a breast. It is possible that another class of material other than plastic may be used. Despite its thinness and flexibility, when actuated by the guide member 211, the shaping member is capable of displacing the breast from lower in the breast cup 130, upwardly and centrally, and to also project the breast from the body and outside the upper constrains of the breast cup 130. Suitably, the stopper or block 220 partially overlays the shaping member along the outside area of the breast cup 130 wherein the stopper 220 prevents the breast from bulging unnaturally out the side of breast cup 130 when adjusted via the shaping member 210.

There are many ways to vary the elements of these embodiments and remain within the spirit and scope of the present invention.

For example, the shoulder straps are an optional feature of the garment so that a shoulder strapless garment employing the adjustable breast positioning system does not depart from the spirit and intent of this disclosure. Furthermore, the pliable shaping member 210 and connecting members 212 connection to the breast cup 130 (i.e., the pivot point) can be at various locations around the perimeter of the breast cup depending on the cup size and load increases, rather than at the locations depicted in the drawings. This may also be preferred for creating less lift/more cleavage enhancement. The pliable shaping member 210 may also be located between layers of a multilayer breast cup with the pivot point being on an exterior or non-exterior layer, either one. Moreover, the adjustable breast positioning system may utilize a plurality of pliable shaping members 210.

Referring to the figures, the garment 100 may also be the form of a swimsuit top incorporating the adjustable breast positing system 200 with the elements present as shown. The discreteness of the adjustable breast positioning system allows a totally exposed garment to employ the system and the system to be unnoticeable except for its results. The swimsuit may be worn or placed on the body in any manner known to those of skill in the art without affecting the functionality of the adjustable breast positioning system 200. In use and operation the adjustable breast positioning system 200 of a swimsuit may function in the same manner disclosed above.

In one embodiment, pliable shaping member 210 is constructed of flexible material comprised of a surface area which may vary greatly depending on the size of breast cup 30 and whether lift is desired more than projection from the body, or the reverse. The shape of pliable shaping member 60 is also influenced by where the connecting members 212 are attached to the breast cup 130, the structural configuration of the garment 100, the desired angle of inclination of the member 210 when taut, and other factors, such as the preferred change in the breast position.

Alternatively, the pliable shaping member 210 may be of a more resilient type thereby performing somewhat like a lever to position the breast with the fulcrum of the lever being at the connection point of the connecting members 212 to the breast cup 130. In this case, pliable shaping member 210 is constructed resilient enough to position the breast in this way, with the particular material used determining how thick pliable shaping member 210 needs to be. Additionally, the pliable shaping member 210 may be constructed of multiple sections operatively coupled to one another.

Looking at FIG. 2A through 3B, it can be seen that, in the initial position, flexible shaping member 210 conforms to and is pressed into breast cup 30 by a breast. The flexible shaping member 210 covers a part of the breast cup 130 toward the side of the chest. Guide member 211 runs from where it is attached to pliable shaping member 210 across breast cup 130, and through the center 121, where it terminates at attaching means 213 (see FIG. 2A).

To actuate positioning, anchor 213 is adjusted further along the fastening portion 122 (compare FIG. 2A with FIG. 3A) and maintained by a hook and loop connection. The guide member 211 is moved with anchor 213 and pulls on the pliable shaping member 210 which pivots for suspension from the connecting members 212 wherein the load on the platform is distributed to the garment thereby and counter via the constriction of the chest band 120.

As pliable shaping member 210 continues to be pulled, it undergoes a shape transformation for displacing the breast upward, forward, and inward toward the center of the wearer's chest while concomitantly increasing the volume of the breast outside an upper portion of said at least one breast cup for providing said improved visual presentation of the breast. More specifically, the shaping member transitions from a curvilinear configuration to a planar configuration via opening of the cutout 214 and tautening of the shaping member 210 under the applied force (see FIGS. 6A through 6C).

Referring again to FIGS. 2A through 3B, the guide member 211 controls or guides the motion of pliable shaping member 210, keeping pliable shaping member 210 close to the body of the wearer, ensuring that the system 200 elements position the breast instead of merely adjusting/moving over the surface of the breast.

Typically, the working elements of the adjustable breast positioning system will be surrounded by layers of pliant flexible material, cloth, or foam such as a cup panel and or cover layer 132 shown in FIG. 2B. Layers of pliant flexible material may also be interspersed between the working elements of the positioning system, particularly if an interspersed layer does not cover the entire area of breast cup 130. These layers may prevent the guide member 211 or connecting members 212 from becoming tangled with the other elements and will also smooth the outward appearance of the adjustable breast positioning system. In particular, multiple layers of material may form the outermost cup panel covering the outermost elements of the adjustable breast positioning system to enhance the natural look of the positioned breasts.

Regardless of how many layers of material a breast cup may have, it will have two visible sides and a perimeter or rim at its defining edges. One side, the observable side, is visible to others observing a person wearing the garment (see FIGS. 2A and 3A). The other side, the wearer side of the breast cup, is not generally visible while the garment is worn because it is placed against the wearer (see FIGS. 2B, 2C, and 3B). The wearer side may, however, be visible when the garment is not being worn. It is preferred that the observable side of the breast cup appear natural and not supplemented, while it is preferred that the wearer side of the breast cup be comfortable for the wearer. The perimeter of the breast cup will be free along some sections of the perimeter and attached to other parts of the garment along other sections of the perimeter.

Additionally, the connecting members 212 and guide member 211 may be located between layers if there are multiple layers. It is even possible that connecting members 212 and guide member 211 could pass from one side of a layer through an aperture in the layer to the other side of the layer. In this case the aperture itself may act as a guide loop.

Furthermore, depending on the direction of breast positioning, specifics of embodiments may be altered. For example, the particular location within breast cup 130 of the connection of connecting members 212 affects the motion of pliable shaping member 210, and the resulting motion of breast movement. Similarly, the angle of inclination or pitch of flexible shaping member 210 will affect the direction of positioning and the shape of breast 120. The pliable shaping member 210 may be guided at different inclination angles or paths to allow smooth and desired operation of the adjustable breast positioning system 200. The location and type of anchor may be changed as well.

Accordingly, and in one aspect, an embodiment of the invention provides a breast positioning system for a garment having at least one breast cup for receiving a breast of a wearer, the breast positioning system comprising: a pliable shaping member situated at a first position within a bottom portion of the at least one breast cup and having an end attached to the at least one breast cup in an area nearer a side of the wearer's chest and an end distal from the attached end; the pliable shaping member comprising initially a curvilinear shaped section having, when the pliable shaping member is situated at the first position, a first curvature transitioning from the attached end and extending along the inner contours of the at least one breast cup at a location proximate a lower periphery of the at least one breast cup; and means for applying a force to the distal end of the pliable shaping member while the pliable shaping member is retained at the attached end for decreasing the first curvature of the pliable shaping member to a second different curvature or plane that is less proximate to the inner contours of the at least one breast cup than the first curvature for reducing available breast cup volume within the at least one breast cup for providing a breast positioning system.

In another aspect, an embodiment of the invention provides a method for providing an adjustable positioning support for a breast received within a breast cup of a woman's garment, the steps comprising: locating a first flexible member within the breast cup; and applying a force to a second end of the first flexible member while retaining a first end of the first flexible member for suspending the flexible member across the breast cup for reducing the available volume for the breast within the breast cup for providing an improved visual presentation of the breast.

In another aspect, and referring to FIGS. 2A through 3B, an embodiment of the invention provides a breast positioning system for a garment comprising at least one breast cup 30 having an available breast cup volume for receiving a breast of a wearer, the breast positioning system comprising: a pliable shaping member 210 situated at a first position within the at least one breast cup 30 and having an end attached to the at least one breast cup via connecting members 212 and an end distal from the attached end; the pliable shaping member 210 comprising initially a curved section transitioning from the attached end and extending along the contours of the at least one breast cup at a first location proximate when the pliable shaping member is situated at the first position; and means for applying a force to the distal end of the pliable shaping member 210 while the pliable shaping member 210 is retained at the attached end for flattening at least a portion of the curved section while positioning the pliable shaping member 210 to a second location less proximate to the contours of the at least one breast cup 130 than the first location for providing breast positioning by displacing the breast upward along the positive Y axis, forward along the positive Z axis, and inward toward the center or cleavage area of the wearer's chest along the horizontal positive X axis while concomitantly increasing the volume of the breast outside an upper portion of the breast cup for providing an improved visual presentation of the breast. In one embodiment, the force applying means comprises the guide member 211 and anchor 213, the anchor 213 movable from place to place on the fastening portion 122 of the garment for adjusting a degree of flattening of at least the portion of the curved section of said pliable shaping member 210.

In another aspect, and referring to FIGS. 2A through 3B, an embodiment of the invention provides a breast positioning system for a garment comprising at least one breast cup 30 having an available breast cup volume for receiving a breast of a wearer, the breast positioning system comprising: a pliable shaping member 210 situated at a first position along the contour of the at least one breast cup 130; the pliable shaping member 210 having an end attached to the at least one breast cup via connecting members and an end distal from the attached end; the pliable shaping member 210 comprising initially a curved section transitioning from the attached end and extending along the contour of the breast received within the at least one breast cup 30; platform stopper member positioned along the side of the breast; and means for applying a force to the distal end of the pliable shaping member 210 while the pliable shaping member 210 is retained at the attached end for flattening at least a portion of the curved section and at least a portion of the shaping member 210 for reducing the available breast cup volume for the breast received within the at least one breast cup for providing breast positioning by displacing the breast upward along the positive Y axis, forward along the positive Z axis, and inward toward the center or cleavage area of the wearer's chest along the horizontal positive X axis while concomitantly increasing the volume of the breast outside an upper portion of the breast cup for providing an improved visual presentation of the breast. In one embodiment, the force applying means comprises the guide member 211 attached to the distal end of the pliable shaping member 210 and attached to an anchor 213 movable from place to place on the fastening portion 122 of the garment 100 for adjusting said degree of flattening of at least said portion of said curved section and at least said portion of said flexible shaping member at least partially overlaying said curved section of said pliable shaping member.

These aspects, among other things, demonstrate the industrial applicability of this invention.

Moreover, it should be apparent that further numerous structural modifications and adaptations may be resorted to without departing from the scope and fair meaning of the present invention as set forth hereinabove and as described herein below by the claims.

I claim:

1. A breast shaping apparatus for a human wearer, said apparatus comprising:

a pliable material configured with an angle relative to an X-Y plane of the wearer's chest, said pliable material and disposed within a breast cup, said X-Y plane having a Y direction relative thereto that is vertical and an X-direction relative thereto that is horizontal;

wherein the pliable material is connected to the breast cup at a connection;

wherein tautening the pliable material against said connection by applying a tensile force primarily in a X direction relative to said X-Y plane, decreases the angle of the pliable material relative to the X-Y plane of the wearer's chest, said tensile force being applied toward the center of the wearer's chest; and, whereby changing the angle of the material causes a breast placed within the breast cup to flow upwardly in the Y direction relative to the X-Y plane of the wearer's chest and toward the center of the wearer's chest in the X direction relative to the X-Y plane of the wearer's chest.

2. The breast shaping apparatus of claim 1 wherein the connecting members are elastic.

3. The breast shaping apparatus of claim 1 wherein tautening the pliable material results in an angle of the pliable material being within the range of negative thirty and positive thirty degrees relative to the X-Y plane of the wearer's chest.

4. The breast shaping apparatus of claim 1 wherein a breast is positioned within the breast cup against the pliable material and wherein at least a portion of the breast flows outside a perimeter of the breast cup.

5. The breast shaping apparatus of claim 4 wherein the breast cup is operationally configured to retain an initial form during breast flow.

6. The breast shaping apparatus of claim 4 applied to a woman's garment having the breast cup and wherein the breast cup is operationally configured to maintain a position relative to the garment while a breast is moving in response to a change in the angle of the pliable material.

7. A woman's garment comprising:

at least one breast cup; and, at least one shaping member that is movable within the breast cup to cause at least one breast to flow upwardly in a Y direction relative to a X-Y plane of the woman's breast and toward the center of the woman's chest in the X direction relative to the X-Y plane of the wearer's chest;

wherein a form of the breast cup remains relatively constant during flow of the breast.

8. The garment of claim 7 wherein the shaping member applies pressure to the breast via moving the shaping member towards (a) the center of the wearer's chest and (b) towards the breast.

9. The woman's garment of claim 7 further comprising a grip, defined by an area of increased surface tension inside said breast cup, said grip for preventing flow of the breast in the X direction away from the center of the chest.

10. The garment of claim 7 wherein:

the shaping member is configured with an angle relative to said X-Y plane;

moving the shaping member changes the angle relative to said X-Y plane;

changing the angle of the shaping member causes the flow of the breast so that at least a portion of the breast moves forwardly and upwardly relative to the woman and outside the confines of the breast cup rim.

11. A method of adjusting a person's breast comprising the steps of:

inserting the breast into a breast cup with a breast shaping member disposed therein with a connection to a portion thereof, the shaping member having an angled portion that has an angle relative to an X-Y plane of the person's chest, said angled portion disposed within a breast cup, said X-Y plane having a Y direction relative thereto that is vertical and an X-direction relative thereto that is horizontal;

tautening the shaping member against said connection so that the angled portion of the shaping member changes angles relative to said X-Y plane;

whereby changing the angle of the angled portion of the shaping member causes the breast to flow so that at least a portion of the breast appears to move at least forwardly and upwardly relative to the woman and outside the confines of the breast cup; and wherein the breast cup is affixed to a woman's garment and wherein the observable form of the breast cup remains constant during flow of the breast.

12. The method of claim 11 wherein a grip is defined by an area of increased surface tension inside said breast cup, said grip for preventing flow of the breast in the X direction away from the center of the chest, and wherein the method further comprises the steps of:

restraining the breast from moving in the direction of the grip.

13. The method of claim 11 wherein the step of tautening the shaping member is accomplished via the application of a tensile force primarily in a X direction relative to said X-Y plane against the connection of the shaping member to said portion of said breast cup.

14. The method of claim 11 wherein the flow of the breast moves the breast at least horizontally relative to the person.

15. The method of claim 14 further comprising the step of restricting the horizontal movement of the breast to a direction toward the center of the person's chest via a grip that is defined by an area of increased surface tension inside said breast cup, said grip for preventing flow of the breast in the X direction away from the center of the chest.

16. The method of claim 11 wherein the shaping member applies pressure to the breast.

17. The method of claim 11 wherein the breast cup is operationally configured to retain an initial form during flow of the breast.

18. A breast positioning system for a first breast cup of a person's garment comprising:

the first breast cup;

a second breast cup;

a pliable platform within the first breast cup;

a connecting member;

a fastening portion that is beneath the second breast cup, said fastening portion with a first location and second location;

a fastening means;

wherein the connecting member is attached to the pliable platform and a portion of the first breast cup;

wherein the fastening means mechanically communicates with the pliable platform;

wherein the fastening portion is positioned outside the breast cup on the garment;

wherein positioning the fastening means at the first location of the fastening portion results in a first configuration of the pliable platform within the first breast cup; and wherein securing fastening means to the second location of the fastening portion causes the pliable platform to tauten within the breast cup without changing an initial form of the first breast cup.

19. The system of claim 18 wherein the shaping member applies pressure to a breast of the person.

20. The system of claim 18 further comprising a grip, said grip defined by an area of increased surface tension inside said breast cup, said grip for preventing flow of a breast of the person in a horizontal direction away from the center of the person's chest.

21. The system of claim 18 wherein the taut pliable platform is configured to press a breast deposited within the first breast cup inwardly, forwardly and upwardly relative to the person and partially outside the confines of the first breast cup.

22. The system of claim 18 wherein the taut pliable platform is configured to press a breast deposited within the volume of the first breast cup horizontally relative to the person and wherein a grip, said grip defined by an area of increased surface tension inside said breast cup, restricts the horizontal movement of the breast to a direction toward the center of the person's chest.

23. The breast positioning system of claim 18 wherein the first breast cup is operationally configured to retain an initial form whether the anchor is positioned in the first or second location.

24. The breast positioning system of claim 18 wherein the first breast cup is operationally configured to maintain a position relative to the garment whether the fastening means is positioned in the first or second location.

25. A woman's garment comprising:

at least one breast cup;

at least one shaping member, that is movable within the breast cup to cause flow of at least one breast; and, wherein said breast cup retains an initial form during movements of said shaping member therein.

26. The breast shaping apparatus of claim 7 wherein the breast cup is operationally configured to maintain a position relative to the garment while a breast is breast is deforming in response to movement of the shaping member.

27. A breast shaping apparatus comprising:

a pliable material configured with an angle relative to an X-Y plane of the wearer's chest, said pliable material disposed within a breast cup, said X-Y plane having a Y direction relative thereto that is vertical and an X-direction relative thereto that is horizontal;

wherein the pliable material has a point that is affixed at a location relative to the breast cup;

wherein tautening the pliable material, by applying a tensile force primarily in a X direction relative to said X-Y plane against said point, changes the angle relative to said X-Y plane; and, wherein changing the angle of the pliable material coincides with a flow of a breast placed within the breast cup.

28. The breast shaping apparatus of claim 27 wherein tautening the pliable material results in an angle of the pliable material being within the range of negative thirty and positive thirty degrees with respect to the X-Y plane of the wearer's chest.

29. The breast shaping apparatus of claim 27 wherein tautening the pliable material results in pressure on the breast via moving the shaping member towards (a) the center of the wearer's chest and (b) towards the breast.

30. The garment of claim 7 wherein:

the shaping member is configured with an angle relative to said X-Y plane;

moving the shaping member changes the angle relative to said X-Y plane;

changing the angle of the shaping member relative to said X-Y plane causes the flow of the breast so that at least a portion of the breast appears to move forwardly relative to the woman and outside the confines of the breast cup.

31. The garment of claim 7 wherein:

the shaping member is configured with an angle relative to said X-Y plane;

moving the shaping member changes the angle relative to said X-Y plane;

changing the angle of the shaping member causes the flow of the breast so that at least a portion of the breast appears move upwardly relative to the woman and outside the confines of the breast cup.

32. The system of claim 18 wherein the taut pliable platform is configured to press a breast within the breast cup inwardly relative to the woman and partially outside the confines of the breast cup via moving the shaping member towards (a) the center of the wearer's chest and (b) towards the breast.

33. The system of claim 18 wherein the taut pliable platform is configured to press a breast within the breast cup forwardly relative to the woman and partially outside the confines of the breast cup via moving the shaping member towards (a) the center of the wearer's chest and (b) towards the breast.

34. The system of claim 18 wherein the taut pliable platform is configured to press a breast within the breast cup upwardly relative to the woman and partially outside the confines of the breast cup via moving the shaping member towards (a) the center of the wearer's chest and (b) towards the breast.

35. The method of claim 18 further comprising the steps of:

locating the second location on a stiffening element of the second breast cup; and mechanically connecting the taut shaping member to the second location on said stiffening element.

36. A woman's garment comprising:

first and second breast cups; and a means for moving a breast within the first cup, wherein said means is configured to mechanically connect to stiffening element of the second breast cup to hold a breast in a configuration that is partially outside the confines of the breast cup, wherein an initial form of the first breast cup is retained during movement of the breast.

37. A woman's garment comprising:

a first breast cup adjacent to a sternum of a wearer and containing a breast of the wearer;

a second breast cup positioned relative to the first breast cup;

wherein the first breast cup includes a rim with a stiffening device on an underside thereof;

a shaping member that is movable within the first breast cup to cause flow of the breast;

a means for moving the shaping member so that the breast moves towards the sternum, outside a portion of the rim, away from an inside of the first breast cup;

wherein the stiffening device maintains the position of the second breast cup relative to the first breast cup;

a means for securing the position of the shaping member within the breast cup so that the shaping member holds a position of the breast, a fastening portion of said means being located on the second breast cup; and, wherein an initial form of the first breast cup is retained while the position of the shaping member is secured via said means for securing the shaping member within the breast cup.

38. The woman's garment of claim 37 wherein the stiffening member of the first breast cup inhibits rotation of the first and second breast cups.

39. The woman's garment of claim 37 wherein the stiffening member of the breast cup counteracts flow of the rim of the breast cup during movement of the shaping member.

40. The woman's garment of claim 37 wherein the breast moves away from the inside of the first breast cup for a fraction of the depth of the first breast cup.

41. A woman's garment comprising:

a chest band;

at least one breast cup adjacent to a sternum of a wearer and containing a breast of the wearer;

wherein the at least one breast cup includes a rim;

a shaping member that is movable within the breast cup to cause flow of the breast;

a means for moving the shaping member so that the breast moves towards the sternum, outside a portion of the rim, away from an inside of the breast cup; and, a means for securing the position of the breast cup during flow of the breast, a fastening portion of said means for securing the position of the breast cup during flow of the breast being located on a second breast.

42. The woman's garment of claim 41 wherein the chest band counteracts flow of the garment during movement of the shaping member.

43. The woman's garment of claim 41 wherein the garment accomplishes movements of the breast without changing the appearance of the garment.

44. The woman's garment of claim 41 wherein the breast moves away from the inside of the breast cup for a fraction of the depth of the breast cup.

* * * * *